United States Patent [19]

Mestieri

[11] Patent Number: 4,945,816

[45] Date of Patent: Aug. 7, 1990

[54] RADIAL PISTON HYDRAULIC MOTOR WITH ROTARY CAM POSITION ENCODER AND VALVE CONTROL SYSTEM

[75] Inventor: Renzo Mestieri, King City, Canada

[73] Assignee: Black Gold Development Corporation, Concord, Canada

[21] Appl. No.: 230,435

[22] Filed: Aug. 10, 1988

Related U.S. Application Data

[63] Continuation of Ser. No. 803,597, Dec. 2, 1985, abandoned.

[51] Int. Cl.[5] ..... F01B 1/06; G05B 1/06

[52] U.S. Cl. ..... 91/473; 91/476; 91/497; 60/425; 318/640

[58] Field of Search ..... 60/368, 433, 448, 425, 60/451–452, 463, 489; 91/473, 476, 488, 497; 123/613, 617, 477; 318/640, 653

[56] References Cited

U.S. PATENT DOCUMENTS

| | | | |
|---|---|---|---|
| Re. 29,561 | 3/1978 | Ford | 123/477 |
| 3,002,462 | 10/1961 | Raymond | 417/214 X |
| 3,650,180 | 3/1972 | Gantschnigg et al. | 91/488 |
| 3,695,146 | 10/1972 | Orshansky | 91/488 |
| 3,708,681 | 1/1973 | Ivers | 318/640 |
| 3,738,111 | 6/1973 | Fletcher | 417/214 X |
| 4,004,498 | 1/1977 | Aoki | 91/476 |
| 4,103,489 | 8/1978 | Fletcher et al. | 60/451 X |
| 4,106,461 | 8/1978 | Giannini | 123/613 |
| 4,116,174 | 9/1978 | Schlichting | 123/613 X |
| 4,474,104 | 10/1984 | Creffield | 60/448 X |
| 4,507,918 | 4/1985 | Holleyman | 91/476 X |
| 4,644,749 | 2/1987 | Somes | 60/489 X |

FOREIGN PATENT DOCUMENTS

| | | | |
|---|---|---|---|
| 2621764 | 11/1977 | Fed. Rep. of Germany | 318/640 |
| 12853 | 2/1981 | Japan | 318/653 |
| 113106 | 7/1982 | Japan | 318/640 |
| 220091 | 12/1984 | Japan | 318/653 |
| 2112061 | 7/1983 | United Kingdom | 123/613 |

OTHER PUBLICATIONS

Yeaple, F., *Fluid Power Design Handbook*, New York: New York, Marcel Dekker, Inc., 1984, pp. 153–154.

*Primary Examiner*—Edward K. Look
*Assistant Examiner*—George Kapsalas
*Attorney, Agent, or Firm*—Melvin Sher; Robert Mitchell; Guy Houle

[57] ABSTRACT

A radial piston hydraulic motor includes an in-board computer which permits monitoring and control of various operating parameters. A position code disc is associated with the shaft of the motor by means of which the position of the drive cam on the shaft, relative to the individual piston can be sensed and fed to the computer. The motor is of high versatility and performance.

3 Claims, 4 Drawing Sheets

RADIAL PISTON HYDRAULIC MOTOR WITH ROTARY CAM POSITION ENCODER AND VALVE CONTROL SYSTEM

This is a continuation of application Ser. No. 803,597, filed Dec. 2, 1985, now abandoned.

BACKGROUND OF THE INVENTION

1. Field of the Invention

The invention relates to an improved radial piston hydraulic motor, more especially the invention is concerned with a radial piston hydraulic motor of high versatility and performance especially suitable for applications requiring uniform torque, constant or variable speed, and high starting torque, which includes an in-board computer.

2. Description of Prior Art

Radial piston hydraulic motors include a plurality of piston-cylinder assemblies mounted radially about a rotatable shaft. The pistons engage a cam keyed to a shaft, and sequentially act on the cam to drive the shaft. A mechanical valve system for control of the flow of hydraulic fluid to the piston-cylinder assemblies is mounted in a stationary manifold about the shaft. Free wheeling of the shaft is possible by means of a clutch assembly in the shaft.

The piston-cylinder assemblies are controlled collectively by the mechanical valve system so that all of the piston-cylinder assemblies are used to drive the shaft and it is not possible to disengage individual piston-cylinder assemblies to reduce power input.

Existing radial piston hydraulic motors have limited possibilities for variation of parameters controlling operation of the motor or recognizing mechanical faults at an early stage.

SUMMARY OF THE INVENTION

It is an object of this invention to provide a radial piston hydraulic motor which can adapt a free-wheeling configuration without the use of a clutch assembly.

It is a further object of the invention to provide a radial piston hydraulic motor in which individual piston-cylinder assemblies can be readily brought into and out of operation.

It is still a further object of the invention to provide a radial piston hydraulic motor which has an in-board computer and is susceptible to increased control, and in which various parameters can be monitored continuously to optimize the control.

In accordance with the invention a radial piston hydraulic motor has position code means on the output shaft for rotation therewith. A cam on the shaft is drivingly rotated by a plurality of fluid actuated piston-cylinder assemblies disposed radially about the shaft. An electronic sensing device senses the position code means during rotation of the shaft and provides a signal responsive thereto. A control device receives the signal and provides a control signal to control valves associated with the piston-cylinder assemblies.

The position code means extends circumferentially about the shaft and comprises a code in the form of a plurality of markings. The markings are in predetermined locations about the shaft and provide information as to the location of the lobe of the cam relative to the individual piston-cylinder assemblies.

The position code means may be in the form of an annular disc-shaped member extending radially outwardly of the shaft, the code being formed on the disc face. The code will typically be in the form of a plurality of markings on the disc face spaced, radially of and circumferentially about the shaft. Markings associated with the position of the cam lobe relative to different piston-cylinder assemblies are located at different radial distances from the shaft. In this way the disc face is divided into a plurality of ring-like or annular zones extending circumferentially about the shaft and spaced at different radial distances from the shaft. Each zone is associated with a particular piston-cylinder assembly and markings are located in predetermined positions along the zone which provide information as to the position of the cam relative to the particular piston-cylinder assembly.

The position code means may also be in the form of an annular band mounted circumferentially about the shaft, the code or markings being in predetermined positions on a cylindrical surface of said band and thus extending axially, or parallel to the shaft axis, rather than radially of the shaft.

The position code means may also be in the form of a code or markings applied directly, for example, by printing, to the surface of the shaft, and extending circumferentially about the shaft surface.

The hydraulic motor may also include pressure and temperature sensors which are sensed by the electronic sensing device. The information sensed in this way may also be used to control the motor, by means of the control device which can be arranged to control different components of the motor. For example, the control device may be used to control a hydraulic pump which pumps hydraulic fluid to the motor to drive the pistons.

The information sensed by the electronic sensing device may be fed to a computer and different parameters, for example, shaft horse power, torque and speed of rotation can be calculated and compared with pre-programmed data, and an output signal to the control device may then be established to alter the parameters as desired or based on the pre-programmed data.

BRIEF DESCRIPTION OF THE DRAWINGS

The invention is illustrated in particular and preferred embodiments by reference to the accompanying drawings in which.

DETAILED DESCRIPTION OF THE PREFERRED EMBODIMENTS

Figure 1:
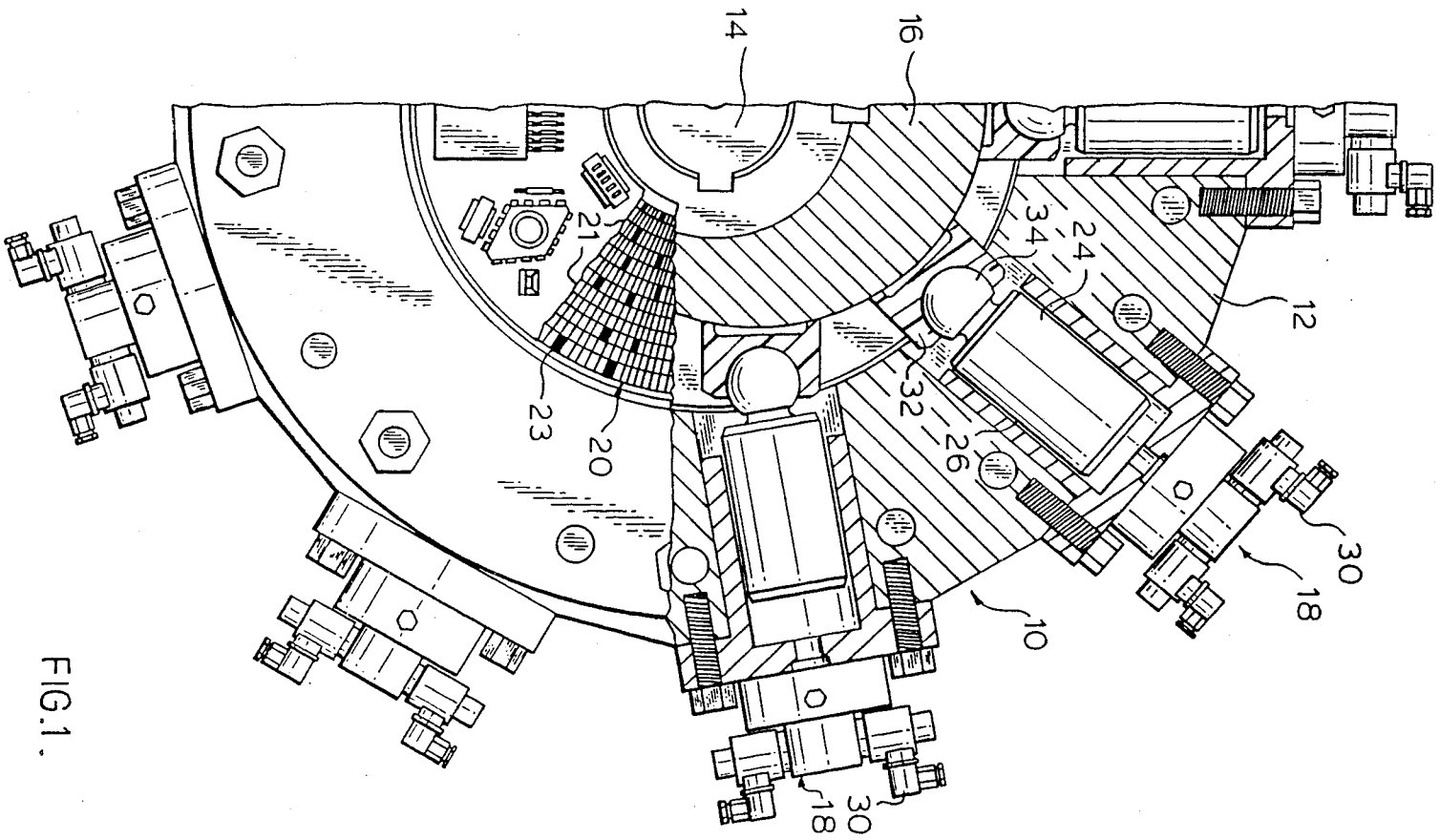
FIG. 1 is a partial front elevation in cross-section showing a radial piston hydraulic motor of the invention.
Figure 2:
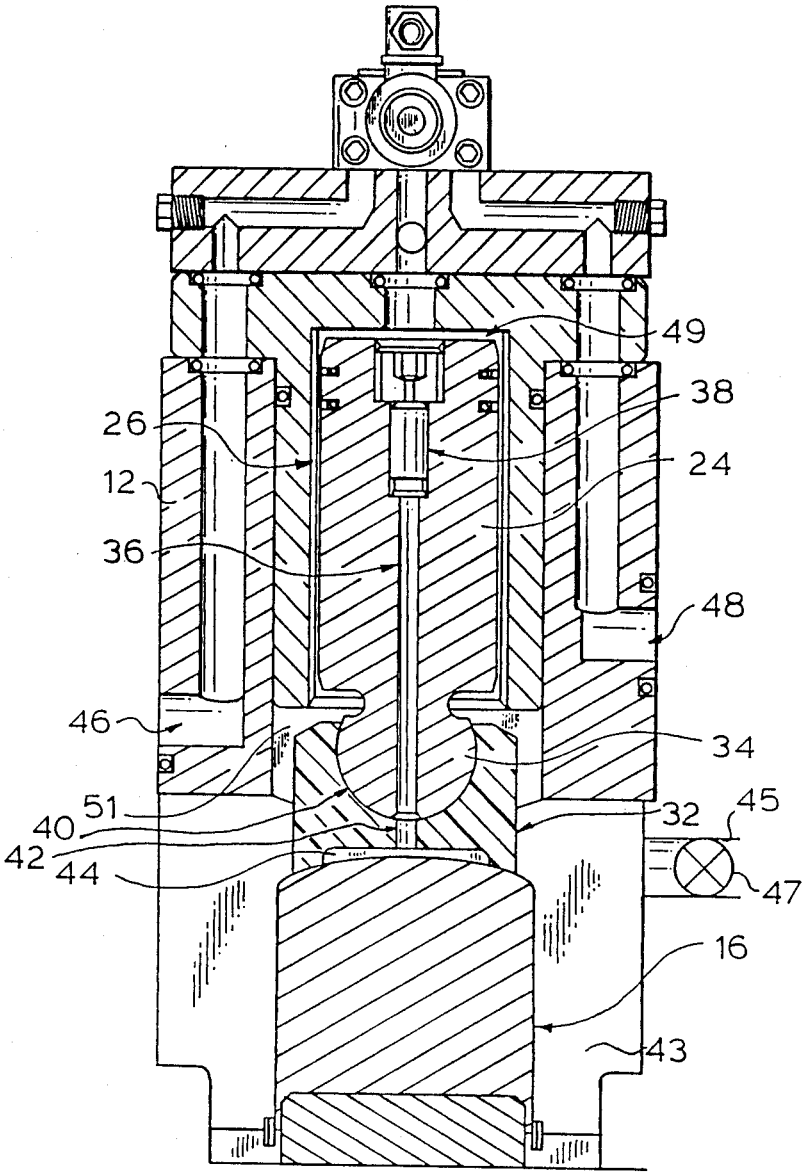
FIG. 2 shows a detail in side elevation of a piston-cylinder assembly of the motor of FIG. 1.
Figure 3:
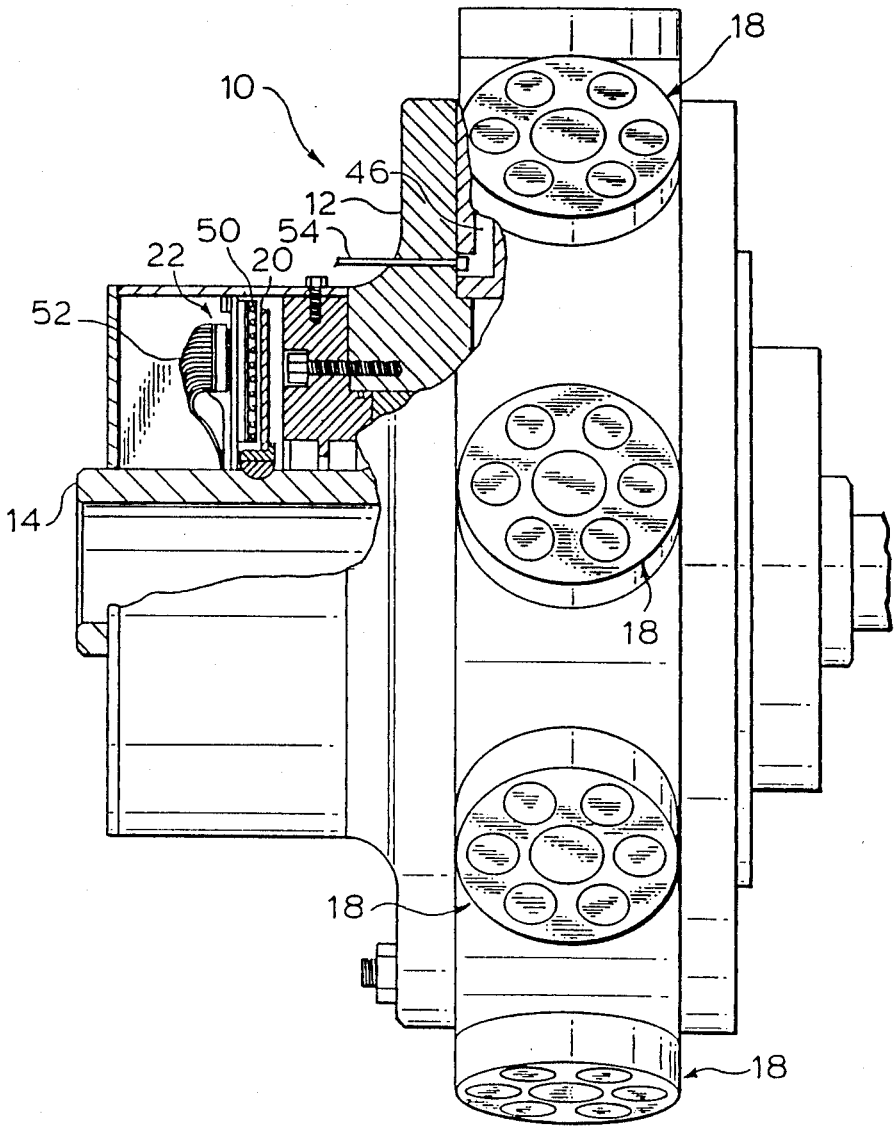
FIG. 3 is a side elevation in partial crosssection of the motor of FIG. 1.

With further reference to FIGS. 1, 2 and 3, a hydraulic motor 10 includes a main body 12 and a shaft 14 journalled for rotation therein.

A drive cam 16 is fixedly mounted on shaft 14 and a plurality of piston-cylinder assemblies 18 is disposed radially about shaft 14, to engage drive cam 16.

A coded or marked disc 20 is mounted for rotation with shaft 14 and an electronic sensor 22 surrounds shaft 14 in spaced apart relationship with disc 20.

The piston-cylinder assemblies 18 each include a piston 24 mounted for reciprocating movement in a cylinder 26.

A valve manifold 28 housing a solenoid valve 30 is mounted on the outer casing of each piston-cylinder assembly 18.

An inner end of each piston 24 has a shoe 32 and a ball 34.

A central fluid passage 36 passe longitudinally of each piston 24 and includes a check valve 38.

Shoe 32 includes a socket 40 which receives the ball 34, and a cavity 44 which is in opposed relationship with cam 16. A passage 42 through shoe 32 communicates passage 36 with cavity 44.

An annular fluid line 46 provides passage for flow of hydraulic fluid to the piston-cylinder assemblies 18 through their respective valve manifolds 28, and a fluid line 48 provides for flow of hydraulic fluid out of the piston-cylinder assemblies 18 through their respective valve manifolds 28.

A chamber 43 is disposed below cylinder 26 about shoe 32 and communicates with an outlet passage 45 having a check valve 47.

A chamber 49 is disposed in an upper end of cylinder 26 above piston 24 when piston 24 is in the upstroke position shown in FIG. 2, and in this position a spacing 51 is defined between shoe 32 and the lower end of cylinder 26.

Electronic sensor 22 includes a reader panel 50 mounted in spaced apart relationship with disc 20 and a controller 52.

A pressure sensor 54 is disposed in fluid line 46 and is electronically connected to controller 52.

Disc 20 includes a disc face 19 having a plurality of discrete annular zones 21. Each zone 21 is associated with one of the piston-cylinder assemblies 18 and has markings 23 in predetermined locations within the zones 21. The positions of the markings 23 in a particular zone 21 are characteristic of the location of cam 16 relative to the pistoncylinder assembly 18 associated with such zone 21.

Figure 4:
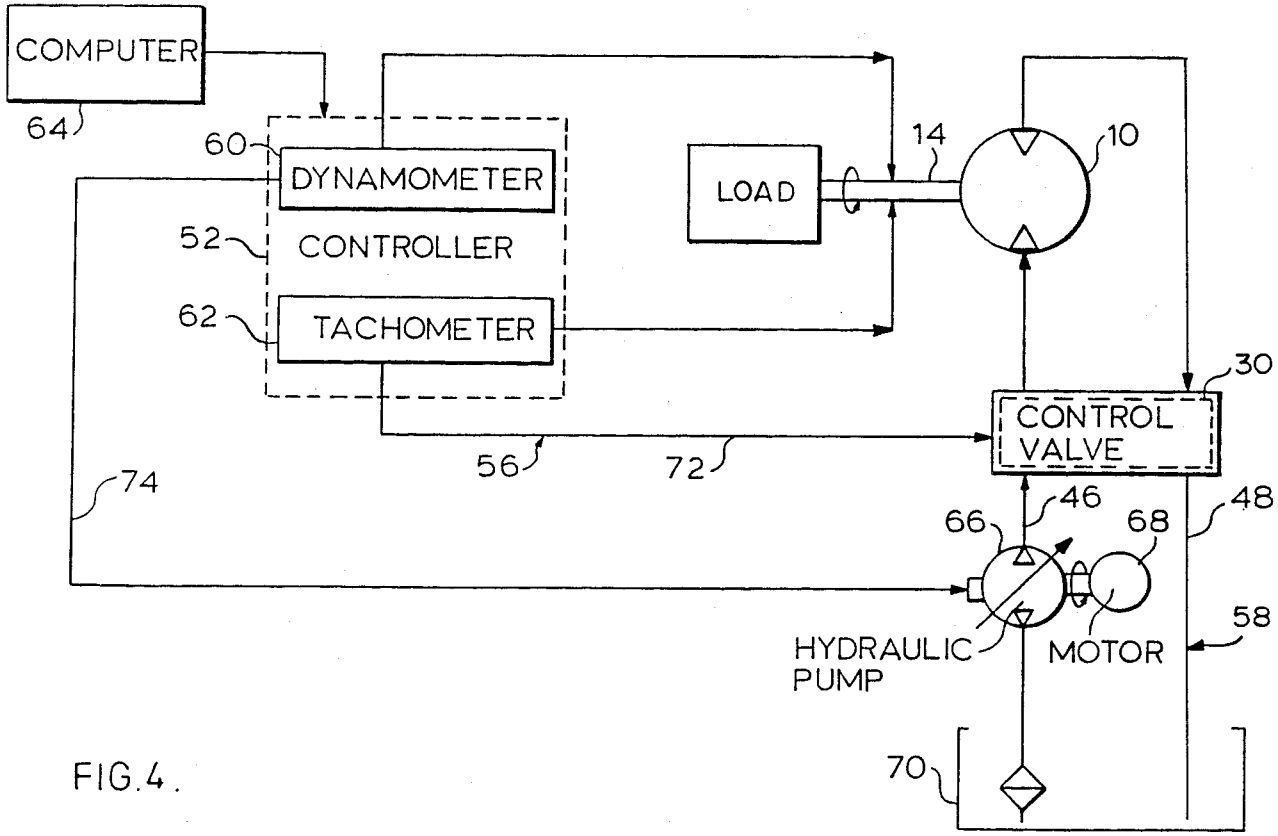
FIG. 4 is a circuit diagram of the hydraulic fluid and electronic circuits of a motor of the invention.

With further reference to FIG. 4, there is shown a systems circuit including an electronic circuit 56 and a hydraulic fluid circuit 58.

Electronic circuit 56 includes controller 52 which includes an internal dynamometer 60 and an internal tachometer 62. An in-board computer 64 is connected to controller 52.

Shaft 14 is shown symbolically as is the motor 10.

The hydraulic circuit 58 includes fluid lines 46 and 48 shown communicating with the valve manifolds 28 and control valves 30. Circuit 58 further includes a hydraulic pump 66, a motor 68 to drive pump 66 and a hydraulic fluid reservoir 70.

Electronic circuit 56 includes a connection 72 between internal tachometer 62 and the valve manifolds 28, housing the control valves 30, and a connection 74 between internal dynamometer 60 and hydraulic pump 66.

In operation of the hydraulic motor 10, high pressure hydraulic fluid, for example, oil at a pressure up to 6000 p.s.i. enters fluid line 46 and branches off to each piston-cylinder assembly 18.

Passage of the hydraulic fluid from line 46 into the respective cylinders 26 to drive the pistons 24 is precisely timed and controlled by solenoid valve 30 of each assembly 18. The hydraulic fluid exerts a force on each piston 24 at a particular instant in time.

At a particular point in time a piston 24 drives shoe 32 in engagement with the lobe of cam 16, to rotatingly drive shaft 14.

The shoe 32 is hydrostatically balanced against the cam 16, the hydraulic force transmitted through the shoe 32 resulting in a normal force, i.e., vectored piston force, on the periphery of cam 16.

The remaining piston-cylinder assemblies 18 at this point experience varying volume displacements depending on the position of each piston 24 relative to the shaft 14 at that point in time.

As the pistons 24 are pushed up or retracted, the volume of hydraulic fluid displaced flows into low pressure fluid line 48 and back to the oil reservoir 70 in circuit 58 (FIG. 4).

In operation hydraulic fluid is pumped downwardly through central fluid passage 36 via check valve 38 and thence through passage 42 and into cavity 44, where the pressure is reduced along a pressure gradient. The hydraulic fluid bleeds from cavity 44 to the interface of shoe 32 and cam 16 to provide a film of fluid which creates an upward hydraulic force which is about 90% of the main downward force, so that a small part of the load is carried by the shoe 32. The result is the creation of a hydrostatic floating of the shoe 32 on the cam 16.

Hydraulic fluid also bleeds into the interface between socket 40 and ball 34.

The presence of the hydraulic fluid at the interface of the shoe 32 and the cam 16, and the interface of socket 40 and ball 34, results in hydrodynamic lubrication, greatly reducing rotational friction, oil viscosity dilution due to temperature rise and unnecessary shoe wear. Thus the motor 10 experiences practically no metal to metal contact between pistons 24, and shoes 32 and the cam 16.

The drive cam 16 and hence the shaft 14 is thus rotated by the successive action of the pistoncylinder assemblies 18.

Hydraulic fluid is maintained under pressure in chamber 43. Check valves 38 and 47 serve to maintain the pressurized fluid in chamber 43 during operation. The pressure in chamber 43 is typically of the order of 200 p.s.i.

With the rotation of shaft 14, disc 20 also rotates and its relative position can be monitored by the reader panel 50 and controller 52. In particular the top dead centre of cam 16 relative to any pistoncylinder assembly 18 is readily obtained by monitoring disc 20. In response to this information the controller 52 can control the valves 30 to disengage particular piston-cylinder assemblies 18, or all of the piston-cylinder assemblies 18 from cam 16.

Thus with all of the valves 30 open, the piston-cylinder assemblies 18 can be lifted off cam 16 so that the motor 10 is in a "free-wheel" mode.

When the valves 30 are opened the piston-cylinder assemblies 18 are lifted from cam 16 by the pressurized fluid in chamber 43. The piston 24 being lifted or raised so that its upper end is accommodated in chamber 49 and shoe 32 extends into spacing 51 and is thereby spaced from cam 16.

By means of the in-board computer 64, the position of the lobe of the cam 16, specifically the top dead centre can be determined at any point in time relative to the piston-cylinder assemblies 18, so that the point in time at which control valves 30 can be opened for a smooth lifting of the pistoncylinder assemblies 18, from cam 16 can be readily determined.

Additionally a "variable displacement" mode can be effected by appropriate control of valves 30 by controller 52 in response to the information in the in-board computer 64 received from disc 20, to meet reduced torque requirements.

The motor 10 thus has increased flexibility and can be stalled, reversed and even locked up to maintain a static load without any external braking system.

In adopting the "free wheel" mode, the load on cam 16 and thus shaft 14 is thus effectively disengaged without the use of a clutch mechanism.

Motor 10 exhibits torque values of consistency and smoothness with a variable speed range, even at low r.p.m., thereby eliminating the need for costly gear reduction. It provides a wide range of motor capacities, so that higher speeds can be obtained without necessarily increasing the flow rate of hydraulic fluid.

By means of the electronic sensor 22 and in-board computer 64 it is possible to disable or remove or introduce selected piston-cylinder assemblies 18 to suit particular speed requirements.

By means of the electronic sensor 22 various computer-related instructions can be implemented from a remote station fed solely by electronic control lines, and without hydraulic control lines.

Additional sensors can be introduced to sense different parameters of the motor 10. The pressure sensor 54 senses the pressure in the fluid line 46 through which the hydraulic fluid is introduced into the piston-cylinder assemblies 18. This pressure is monitored by the electronic sensor 22 and the information is maintained in computer 64 and used in conjunction with sensed information to calculate and provide a continuous reading of other operating parameters. Appropriate signals can be directed to alter the pressure as required to change the operating parameters A pressure sensor can also be disposed in the fluid line 48 and temperature sensors can be introduced whereby any significant fluctuations in temperature indicative of problems such as metal to metal contact, can be recognized in advance and appropriate precautions taken.

The coded disc 20 and in-board computer 64 can be employed to provide information based on which various operating parameters of motor 10 can be modified including speed torque and power.

The motor 10 will typically include an odd number of piston-cylinder assemblies 18, for example, 7 or 9, so as to avoid hydraulic locking.

The hydraulic motor 10 can be employed in a variety of applications including excavators, concrete mixers, winch drives, dredge cutters, plastic extrusion machinery, mining, timberland tree farming machinery, material handling, offshore drilling rigs, amusement rides, conveyor drives, garbage compactors, sugar cane harvesters, log debarkers, asphalt pavers, snowblowers, lathe drives, steel forming, core drilling/tunnel boring, transmission line tensioners, robotics and other applications where uniform torque, constant or variable speed and high starting torque are required.

I claim,

1. A radial piston hydraulic motor comprising:

a hydraulic motor body;

a shaft mounted for rotation in said hydraulic motor body;

a drive cam having a lobe mounted on the shaft for rotation therewith;

a plurality of fluid actuated pistons disposed radially about said shaft for reciprocating movement relative thereto, each piston of said plurality sequentially engaging said lobe of said cam to drivingly rotate said shaft;

a plurality of electronically actuated control valves, a separate valve of said plurality of control valves being associated with a separate piston of said plurality of pistons;

controller means including means for individually and separately actuating each of said control valves;

position code means on said shaft for rotation therewith, said position code means comprising a disc, mounted on said shaft for rotation therewith, and including, on one face of said disc, a plurality of discrete differently coded zones, each code in the zone of said plurality being indicative of the position of said lobe relative to each one of said plurality of pistons at the time said code is being read, whereby to provide continuous readings of the position of said lobe relative to each one of the plurality of pistons throughout the rotational cycle of said disc;

electronic sensing means for continuously sensing the position code means and providing an information signal responsive thereto as a continuous measure of the position of the lobe relative to each one of said plurality of pistons at any point in time;

said controller means including means for receiving said information signal;

an in-board computer connected to said controller means for receiving said information signal as an input signal and for sending an output signal to said controller means to actuate a selected one, or ones, of said control valves as determined by said input signals;

whereby to determine the position of any point on the drive cam, relative to any one of the pistons, at any point in time to thereby determine the point in time for opening each control valve to enable smooth lifting of the piston-cylinder assemblies.

2. A motor according to claim 1, further including fluid passages in said hydraulic motor body for delivery of hydraulic fluid to each piston of said piston plurality via the control valve associated therewith; and a pressure sensor disposed in each fluid passage for sensing fluid pressure in said fluid passage, said pressure sensors being connected to said in-board computer for continuous dispatch thereto of input signals based on the sensed fluid pressure.

3. A motor according to claim 2, wherein said in-board computer is adapted to process said input signal received from said electronic sensing means and said input signals received from said pressure sensors and to calculate different operating parameters selected from torque, speed, horse power, rotation in either direction, stop and start and reverse, based on the received input signals.

* * * * *